US009475291B2

(12) United States Patent
Wanibe

(10) Patent No.: US 9,475,291 B2
(45) Date of Patent: Oct. 25, 2016

(54) IMAGE RECORDING DEVICE

(71) Applicant: SEIKO EPSON CORPORATION, Tokyo (JP)

(72) Inventor: Akihisa Wanibe, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/797,546

(22) Filed: Jul. 13, 2015

(65) Prior Publication Data

US 2015/0314602 A1 Nov. 5, 2015

Related U.S. Application Data

(63) Continuation of application No. 14/100,206, filed on Dec. 9, 2013, now Pat. No. 9,108,415.

(30) Foreign Application Priority Data

Dec. 20, 2012 (JP) ..... 2012-277759

(51) Int. Cl.
*B41J 2/165* (2006.01)

(52) U.S. Cl.
CPC ..... *B41J 2/165* (2013.01); *B41J 2/16547* (2013.01); *B41J 2/16588* (2013.01)

(58) Field of Classification Search
CPC .. B41J 2/16505; B41J 2/165; B41J 2/16552; B41J 2/16538
USPC ..... 347/22, 29–33
See application file for complete search history.

(56) References Cited

U.S. PATENT DOCUMENTS

| | | | | |
|---|---|---|---|---|
| 2007/0035569 | A1 | 2/2007 | Koto et al. | |
| 2009/0284566 | A1* | 11/2009 | Suzuki | B41J 2/16588 347/38 |
| 2011/0149003 | A1 | 6/2011 | Kondo | |
| 2011/0279499 | A1 | 11/2011 | Kemma et al. | |
| 2013/0265365 | A1* | 10/2013 | Moscato | B41J 2/16505 347/33 |

FOREIGN PATENT DOCUMENTS

| | | | |
|---|---|---|---|
| JP | 2004-142365 | A | 5/2004 |
| JP | 2006-069176 | A | 3/2006 |
| JP | 2007-015193 | A | 1/2007 |
| JP | 2009-202439 | A | 9/2009 |
| JP | 4613978 | B2 | 1/2011 |
| JP | 2011-131435 | A | 7/2011 |
| JP | 4786770 | B2 | 10/2011 |
| JP | 2011-218761 | A | 11/2011 |

* cited by examiner

*Primary Examiner* — Jason Uhlenhake
(74) *Attorney, Agent, or Firm* — Global IP Counselors, LLP

(57) ABSTRACT

An image recording device includes a support member, a print head, a maintenance unit, a first guide mechanism and a second guide mechanism. The first guide mechanism is configured to guide movement of the print head between the image recording position and the maintenance-receiving position. The second guide mechanism is configured to guide movement of the maintenance unit between a withdrawn position for separating away from the print head and a maintenance position for drawing nearer to the print head than the withdrawn position while the maintenance unit faces the print head disposed at the maintenance-receiving position. A surface of the maintenance unit facing the print head when the maintenance unit is at the withdrawn position is disposed farther away from the print head in a movement direction of the maintenance unit than a portion of the support surface that is disposed closest to the print head.

8 Claims, 7 Drawing Sheets

IMAGE RECORDING DEVICE

CROSS-REFERENCE TO RELATED APPLICATIONS

This application is a continuation application of U.S. patent application Publication Ser. No. 14/100,206 filed on Dec. 9, 2013. This application claims priority to Japanese Patent Application No. 2012-277759 filed on Dec. 20, 2012. The entire disclosures of U.S. patent application Publication Ser. No. 14/100,206 and Japanese Patent Application No. 2012-277759 are hereby incorporated herein by reference.

BACKGROUND

1. Technical Field

The present invention relates to a technique for a maintenance unit to implement maintenance or for a worker to implement a manual task on a print head for ejecting a liquid and recording an image.

2. Background Technology

A well-known image recording device, as with an inkjet printer, forms an image on a recording medium by ejecting a liquid from nozzles on a print head while orienting the print head to face a support member on which the recording medium is being supported. Generally, in such an image recording device, a maintenance unit can be used to implement maintenance, such as for removing a clogging of the nozzles, on the print head. In addition to maintenance by a maintenance unit, a worker will also often be able to implement a manual task on the print head.

More specifically, in the image recording device of Patent Document 1, an inkjet head faces a guide plate and records an image by ejecting an ink onto a recording paper on the guide plate; in turn, the maintenance unit carries out maintenance and a worker carries out a manual task by pulling the inkjet head out to a position not facing the guide plate. That is to say, when the inkjet head is at a position apart from a position facing the guide plate, a state allowing for the maintenance to be implemented comes into effect when the maintenance unit is attached to the inkjet head, and a state allowing for the manual task to be performed comes into effect when the maintenance unit is not attached, which ensures an opening space in a region facing the inkjet head.

In the image recording device of Patent Document 2, image recording involves a head unit facing a drum and ejecting an ink onto a recording medium that is on the drum. Implementing maintenance, in turn, involves adequately separating the head unit from the drum in the radial direction while still maintaining the state where the head unit and drum face each other, and inserting a maintenance unit between the head unit and the drum and therein causing the maintenance unit to face the head unit. Performance of the manual task by the worker involves withdrawing the maintenance unit from the position facing the head unit, and thereafter pulling the head unit out to a position not facing the drum, thereby ensuring an opening space in the region facing the head unit.

Thus, in the image recording devices of Patent Documents 1 and 2, the configurations allow for the adoption of an image recording state in which a print head (inkjet head, head unit) faces a support member (guide plate, drum) on which a recording medium is being supported and records an image, a maintenance state in which the print head faces a maintenance unit and undergoes maintenance, and a manual task state in which an open space is ensured at a facing position of the print head to allow for a manual task to be done.

Japanese Laid-open Patent Publication No. 2004-142365 (Patent Document 1) and Japanese Laid-open Patent Publication No. 2011-131435 (Patent Document 2) are examples of the related art.

SUMMARY

However, the image recording device of Patent Document 1 suffers from the cumbersome need to attach or detach the maintenance unit to or from the print head every time a switch is being made between the maintenance state and the other states (the image recording state and the manual task state).

In the image recording device of Patent Document 2, a switch is made from the image recording state to the maintenance state in a state where the print head remains facing the support member. For this reason, switching to the maintenance state involves executing the operation of inserting the maintenance unit into a gap formed by separating the print head from the support member, and switching from the maintenance state to another state involves executing the operation of extracting the maintenance unit from the space. As such, the mechanisms for supporting the print head and the maintenance unit have been complicated, requiring a mechanism for movably supporting the print head in the facing direction facing the support member to make it possible to form the gap, and a mechanism for supporting the maintenance unit so as to be rotatable in the peripheral direction of the drum-shaped support member to make it possible to insert and withdraw the maintenance unit to and from the gap.

Thus, a problem has emerged in that switching the state between the maintenance state and the other states requires the inefficient task of attaching and detaching the maintenance unit to and from the print head every time in the image recording device of Patent Document 1, and in the image recording device of Patent Document 2 involves the complex mechanisms for supporting the print head and the maintenance unit.

The invention has been achieved in view of the above problems, and a purpose thereof is to provide the feature of an image recording device able to adopt an image recording state for recording an image with a print head, a maintenance state for a maintenance unit to carry out maintenance on the print head, and a manual task state where a manual task is carried out on the print head, wherein switching between the maintenance state and the other states can be carried out efficiently with a simple configuration.

An image recording device according to one aspect includes a support member, a print head, a maintenance unit, a first guide mechanism and a second guide mechanism. The support member has a support surface configured and arranged to support a recording medium that is conveyed in a conveyance direction. The print head is configured and arranged to eject a liquid from a nozzle to record an image on the recording medium on the support surface of the support member, at an image recording position facing the support surface of the support member. The maintenance unit is configured and arranged to face the print head and execute a maintenance on the print head when the print head is disposed at a maintenance-receiving position, which is a position different from the image recording position, with respect to a width direction of the recording medium, which is a direction intersecting the conveyance direction. The first guide mechanism is configured and arranged to guide movement of the print head between the image recording position and the maintenance-receiving position along the width direction of the recording medium. The second guide mechanism is configured and arranged to guide movement of the maintenance unit between a withdrawn position for separating away from the print head and a maintenance position for drawing nearer to the print head than the withdrawn position while the maintenance unit faces the print head disposed at the maintenance-receiving position. A surface of the maintenance unit faces the print head when the maintenance unit is at the withdrawn position being disposed farther away from the print head in a movement direction of the maintenance unit by the second guide mechanism than a portion of the support surface of the support member that is disposed closest to the print head.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
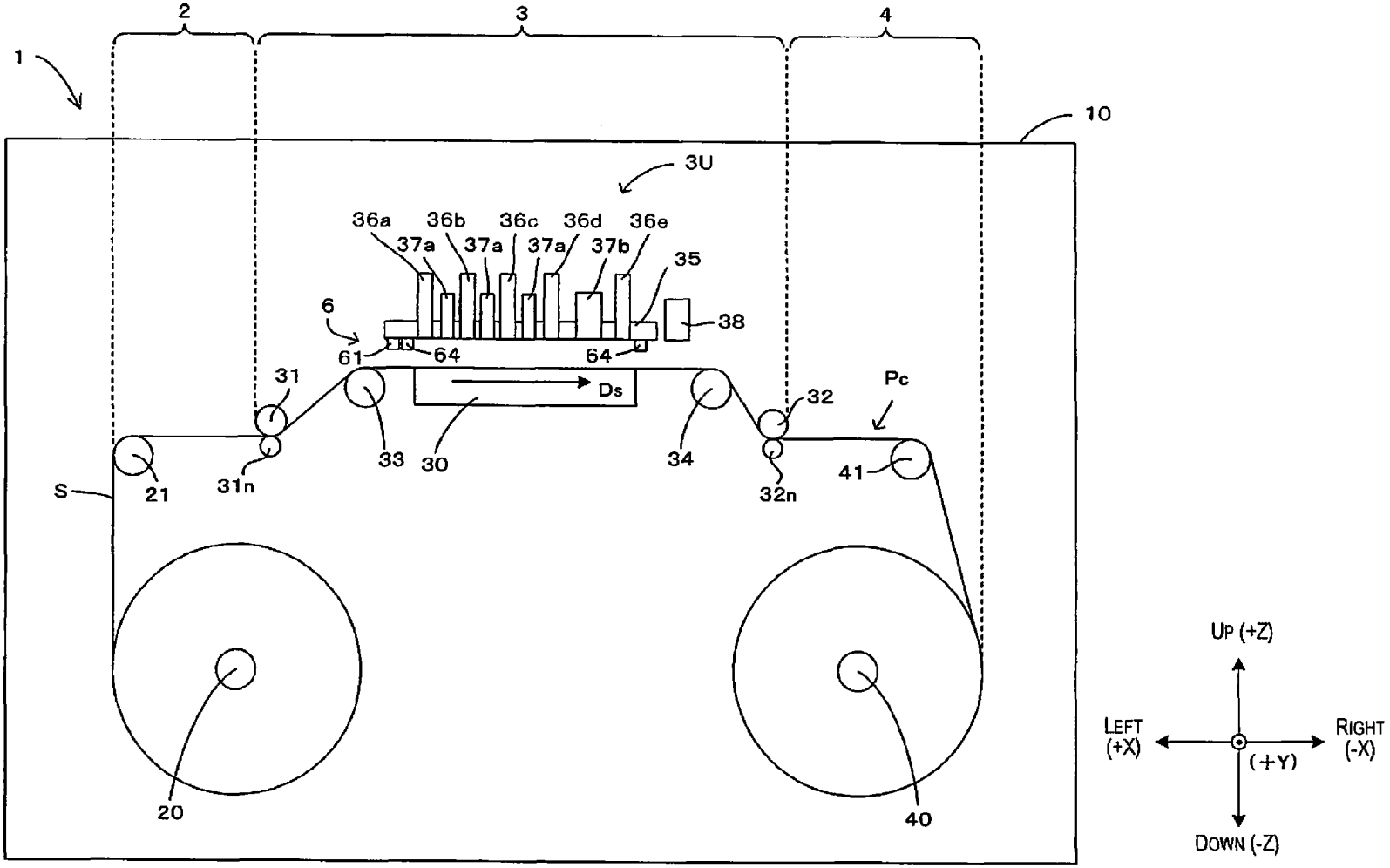
FIG. 1 is a front view schematically illustrating an embodiment of an image recording device as in the invention.

The following describes embodiments of an image recording device as in the invention, with reference to the accompanying drawings. FIG. 1 is a front view schematically illustrating an embodiment of an image recording device as in the invention. In FIG. 1 and subsequent drawings, in order to clarify the relationships of arrangement among the various sections of the device as needed, a three-dimensional coordinate system corresponding to a left-right direction X, front-rear direction Y, and vertical direction Z of an image recording device 1 shall be employed.

As illustrated in FIG. 1, in the image recording device 1, a feed-out section 2, a process section 3, and a take-up section 4 are arrayed in the left-right direction, and an outer casing member 10 accommodates these function sections 2, 3, and 4. The feed-out section 2 and the take-up section include a feed-out spindle 20 and a take-up spindle 40, respectively. The two ends of a sheet S (a webbing) are wrapped in the shape of a roll around the feed-out section 2 and the take-up section 4, and span therebetween. Along a conveyance path Pc spanning in this manner, the sheet S is conveyed from the feed-out spindle 20 to the process section 3, subjected to an image recording process by a head unit 3U, and thereafter conveyed toward the take-up spindle 40. The types of sheet S, which is equivalent to the "recording medium" of the invention, are broadly classified into paper-based and film-based. As specific examples, paper-based includes high-quality paper, cast paper, art paper, coated paper, and the like, while film-based includes synthetic paper, PET (polyethylene terephthalate), PP (polypropylene), and the like. In the following description, whichever side of the two sides of the sheet S is the one on which the image is recorded is referred to as the "front surface", while the side opposite thereto is referred to as the "back surface".

The feed-out section 2 has the feed-out spindle 20, around which an end of the sheet S has been wound, as well as a driven roller 21 around which is wound the sheet S having been drawn out from the feed-out spindle 20. The feed-out spindle 20 supports the end of the sheet S wound therearound in a state where the front surface of the sheet S faces outward. Clockwise rotation of the feed-out spindle 20, as seen in the plane of the paper in FIG. 1, causes the sheet S having been wound around the feed-out spindle 20 to be fed out toward the process section 3, passing by way of the driven roller 21.

The process section 3 is for recording an image onto the sheet S by carrying out, as appropriate, a process using the head unit 3U, which is arranged along the surface of a flat-shaped platen 30 (equivalent to the "support member" of the invention) configured so as to have a planar shape, while the sheet S, having been fed out from the feed-out section 2, is being supported by the platen 30. In the process section 3, a front drive roller 31 and a rear drive roller 32 are provided to both ends of the platen 30, and the sheet S, which is conveyed from the front drive roller 31 to the rear drive roller 32, is supported on the platen 30 and subjected to the printing of an image.

The front drive roller 31 has on the outer peripheral surface a plurality of minute projections formed by spraying; the sheet S, having been fed out from the feed-out section 2, is wound therearound from the front surface side. Then, the front drive roller 31 rotates in the counterclockwise direction as seen in the plane of the paper in FIG. 1, thereby conveying the sheet S that has been fed out from the feed-out section 2 toward the downstream side of the conveyance path Pc. A nip roller 31*n* is provided to the front drive roller 31. The nip roller 31*n* comes up against the back surface of the sheet S in a state of having been urged toward the front drive roller 31 side, and catches the sheet S against the front drive roller 31. This ensures the force of friction between the front drive roller 31 and the sheet S, and makes it possible for the front drive roller 31 to reliably convey the sheet S.

A support mechanism (not shown) allows the flat-shaped platen 30 to be supported so that the surface (an upper surface) that supports the sheet is horizontal. Driven rollers 33, 34 are provided to the left and right sides of the platen 30, and the driven rollers 33, 34 wind up, from the back surface side, the sheet S being conveyed from the front drive roller 31 toward the rear drive roller 32. Upper end positions of the driven rollers 33, 34 are arranged so as to be either flush with or slightly below the surface of the platen 30, and configured so as to be able to maintain a state where the sheet S being conveyed from the front drive roller 31 toward the rear drive roller 32 comes up against the platen 30.

The rear drive roller 32 has on the outer peripheral surface a plurality of minute projections formed by spraying; the sheet S, having been fed out from platen 30 and passed by way of the driven roller 34, is wound therearound from the front surface side. Then, the rear drive roller 32 rotates in the counterclockwise direction as seen in the plane of the paper in FIG. 1, thereby conveying the sheet S toward the take-up section 4. A nip roller 32*n* is provided to the rear drive roller 32. The nip roller 32*n* comes up against the back surface of the sheet S in a state of having been urged toward the rear drive roller 32 side, and catches the sheet S against the rear drive roller 32. This ensures the force of friction between the rear drive roller 32 and the sheet S, and makes it possible for the rear drive roller 32 to reliably convey the sheet S.

The sheet S being conveyed from the front drive roller 31 toward the rear drive roller 32 in this manner is conveyed in a conveyance direction Ds over the platen 30 while being supported by the platen 30. Then, in the process section 3, the head unit 3U is provided in order to print a color image onto the surface of the sheet S being supported on the platen 30. More specifically, the head unit 3U includes four print heads 36*a* to 36*d*, arranged side by side from the upstream side toward the downstream side along the conveyance direction Ds. The print heads 36*a* to 36*d* correspond to yellow, cyan, magenta, and black, respectively. Each of the print heads 36*a* to 36*d* faces the surface of the sheet S supported on the platen 30, spaced apart with some clearance, and ejects the correspondingly colored ink in an inkjet format. The ejection of the inks by each of the print heads 36*a* to 36*d* onto the sheet S being conveyed along the conveyance direction Ds forms the color image on the surface of the sheet.

It should be noted that the ink used is a UV (ultraviolet) ink that is cured by being irradiated with ultraviolet rays (light) (i.e., is a photo-curable ink). Therefore, the head unit 3U includes UV lamps 37*a*, 37*b* for causing the ink to cure and be affixed to the sheet S. The execution of this curing of the ink is divided into two stages, which are temporary curing and true curing. A temporary curing UV lamp 37*a* is arranged between each of the print heads 36*a* to 36*d*. In other words, the UV lamps 37*a* are for curing (temporarily curing) the ink so as to prevent the form of the ink from collapsing, by irradiating with weak ultraviolet rays, but without totally curing the ink. A true curing UV lamp 37*b* is in turn provided to the downstream side in the conveyance direction Ds in relation to the print heads 36*a* to 36*d*. In other words, the UV lamp 37*b* is for totally curing the ink by irradiating with stronger ultraviolet rays than those of the UV lamps 37*a*. This manner of executing the temporary curing and true curing enables affixation, onto the surface of the sheet S, of the color image formed by the print heads 36*a* to 36*d*.

The head unit 3U further includes a print head 36*e* on the downstream side in the conveyance direction Ds in relation to the UV lamp 37*b*. This print head 36*e* faces the surface of the sheet S supported on the platen 30, spaced apart with some clearance, and ejects a transparent UV ink onto the surface of the sheet S in an inkjet format. In other words, a transparent ink is further ejected onto the color image that has been formed by the four differently colored print heads 36*a* to 36*d*. A UV lamp 38 is also provided, separately from the head unit 3U, to the downstream side in the conveyance direction Ds in relation to the print head 36*e*. This UV lamp 38 is for totally curing (true curing) the transparent ink ejected by the print head 36*e*, by irradiating with strong ultraviolet rays. This makes it possible to affix the transparent ink onto the surface of the sheet S.

In this manner, in the process section 3, the inks are ejected and cured as appropriate on the sheet S being supported on the platen 30, thus forming a color image that is coated with the transparent ink. The sheet S on which the color image has been formed is then conveyed toward the take-up section 4 by the rear drive roller 32.

The take-up section 4 includes the take-up spindle 40 around which the end of the sheet S is wound, and a driven roller 41 around which the sheet S being conveyed toward the take-up spindle 40 is wound. The take-up spindle 40 supports the end of the sheet S wound therearound in a state where the surface of the sheet S faces outward. Clockwise rotation of the take-up spindle 40 as seen in the plane of the paper in FIG. 1 causes the sheet S to be wound around the take-up spindle 40, passing by way of the driven roller 41.

Herein, the head unit 3U includes a head support section 35 that extends along the conveyance direction Ds and, arranged side by side in the conveyance direction Ds, the print heads 36*a* to 36*e* and the UV lamps 37*a*, 37*b* are configured so as to be detachable from the head support section 35. While mounted onto and supported by the head support section 35, the print heads 36*a* to 36*e* and the UV lamps 37*a*, 37*b* are configured so as to be able to move integrally with the head support section 35. That is to say, when the head support section 35 moves, the print heads 36*a* to 36*e* and the UV lamps 37*a*, 37*b* move along with the head support section 35. In this manner, moving the head support section 35 makes it possible to move all of the print heads 36*a* to 36*e* at once, and thus it is easier to switch to respective states to be described below (an image recording state, a maintenance state, and a manual task state).

Figure 2:
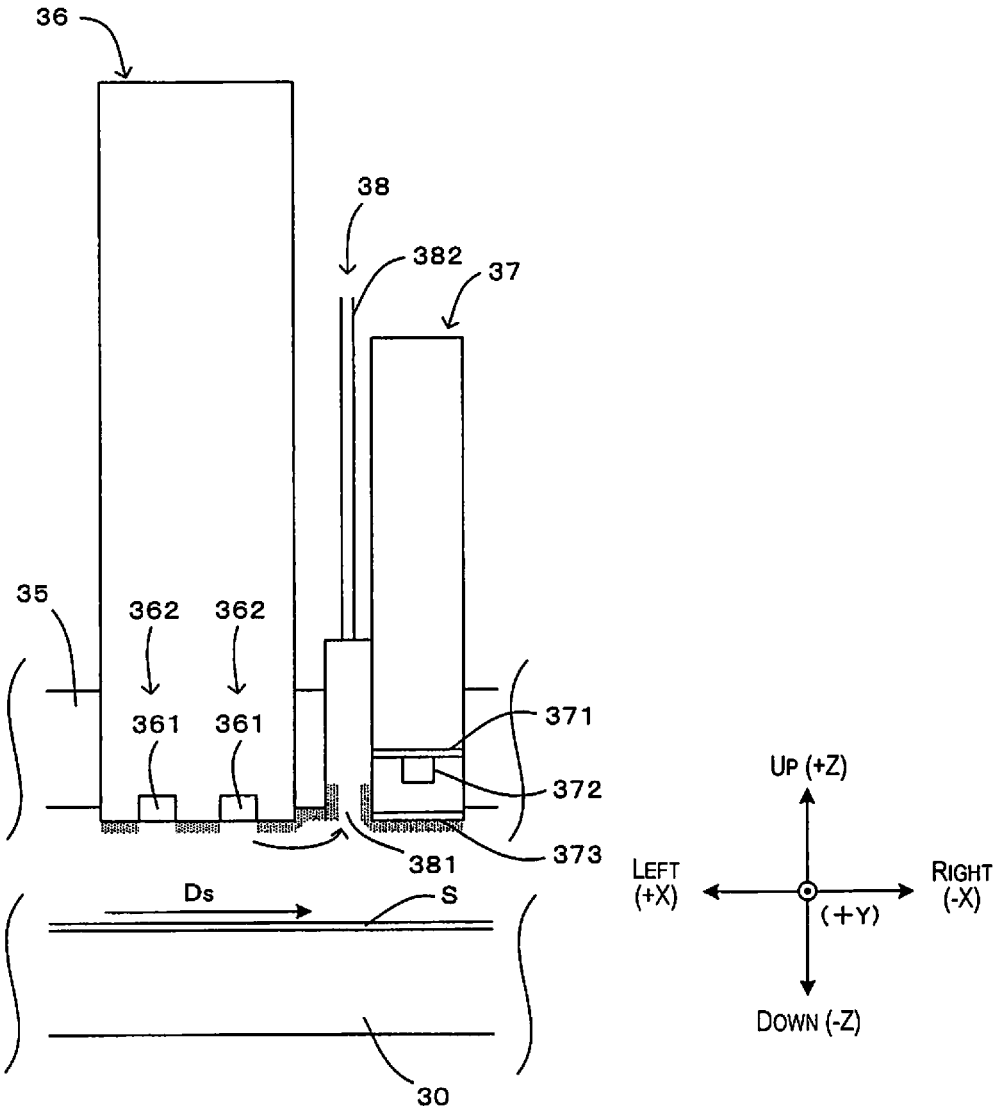
FIG. 2 is an enlarged front view providing a more detailed illustration of a print head periphery.

The description shall next relate to the configuration near the nozzles of the print heads, with reference to FIG. 2. FIG. 2 is an enlarged front view providing a detailed illustration of the periphery of a print head. Herein, the print heads 36*a* to 36*e* have fundamentally the same configuration, with the exception of having correspondingly different colors or types of inks, and the UV lamps 37*a*, 37*b* arranged between the print heads 36*a* to 36*e* also have fundamentally the same configuration. Therefore, in the description for FIG. 2 and beyond, the print heads 36*a* to 36*e* shall be denoted by a print head 36, unless otherwise noted, and the UV lamps 37*a*, 37*b* shall be denoted by a UV lamp 37 as well, also unless otherwise noted.

A plurality of nozzles 361 are provided to a surface of the print head that faces the platen 30 (a nozzle formation surface). A variety of modes can be adopted as appropriate for the arrangement of the nozzles 361, but used herein is a mode where there are a plurality of the nozzles 361 arranged side by side in the front-back direction (Y-direction), thus forming nozzle columns 362 (see FIG. 4), and there are two of the nozzle columns 362 provided in the conveyance direction Ds. The image is formed on the sheet S by the ejection of the ink, at the appropriate timing, onto the sheet S supported on the platen 30 from each of the nozzles 361.

The UV lamp 37 includes light-emitting units 372 that are disposed on a substrate 371. There are a plurality of the light-emitting units 372 arranged side by side in the front-back direction, forming columns of substantially the same length as that of the nozzle columns 362, enabling irradiation of a region in which the image is formed in the width direction of the sheet S. A surface of the UV lamp 37 that faces the platen 30 is constituted of a glass sheet 373; when the light-emitting units 372 irradiate with light, the irradiated light passes through the glass sheet 373 and is incident on the surface of the sheet S supported on the platen 30. The result is curing of the ink that has been ejected onto the surface of the sheet S by the print head 36.

Further, a mist suction section 38 integrally configured with the UV lamp 37 is provided, in a state of being supported on the head support section 35, between the print head 36 and the UV lamp 37 in the conveyance direction Ds. A suction port 381 of the mist suction section 38 extends so as to be of substantially the same length as that of the nozzle columns 362 in the front-back direction, and an opening surface (lower surface) of the suction port 381 is positioned at either the same position as or slightly above the nozzle formation surface of the print head 36 in the vertical direction. The suction port 381 is connected to a negative pressure generation section (not shown) via a suction hose 382, where actuating the negative pressure generation section produces a negative pressure in the suction port 381 and causes an ink mist that becomes a fine spray spreading in all directions to be suctioned into the suction port 381. So doing prevents the spreading ink mist from attaching to the sheet S or from diffusing into the device and contaminating the various parts.

The nozzle formation surface and side surfaces of the print head 36, the lower surface of the head support section 35, the lower surface of the glass sheet 373 of the UV lamp 37, an inner wall surface of the suction port 381 of the mist suction section 38, and the like (places that are shaded in FIG. 2) are susceptible to ink attaching and to this ink either dropping down or spreading and contaminating the sheet S. Moreover, as repeat usage goes on, the nozzles 361 may suffer ink clogging, which interferes with the ejection of ink. A maintenance unit can be provided in the image recording device of an inkjet format, in order to minimize such problems.

A known maintenance unit of such description is, for example, what is described in Japanese Laid-open Patent Publication No. 2012-086409, and therefore a more detailed description thereof is herein omitted, but a brief overview of a maintenance (a first maintenance) executed by the maintenance unit shall be described. Examples of processes carried out by the maintenance unit include capping, cleaning, and wiping. Capping is a process for covering the nozzles with a cap to prevent the viscosity of the ink from increasing within the nozzles. Cleaning is a process for forcibly discharging the ink from the nozzles by capping the nozzles and in this state creating a negative process in the cap. This cleaning makes it possible to remove ink of increased viscosity, bubbles in the ink, and the like from the nozzles. Wiping is a process for using a wiper to wipe the nozzle formation surface of the print head. This wiping makes it possible to wipe the ink away from the nozzle formation surface of the print head.

Such use of the maintenance unit makes it possible to wipe away ink that has attached to the nozzle formation surface of the print head 36, or to eliminate ink clogging of the nozzles 361. However, in some instances the processes using the maintenance unit fail to achieve sufficient removal of ink that has attached to the side surfaces of the print head 36, the lower surface of the head support section 35, the lower surface of the glass sheet 373 of the UV lamp 37, the inner wall surface of the suction port 381 of the mist suction section 38, and the like. In such a case, a worker needs to clean each of the parts of the head unit 3U by hand after the maintenance by the maintenance unit has been executed.

On the basis of such circumstances, the image recording device 1 as in the present embodiment is configured so as to be able to adopt an image recording state in which the print head 36 faces the platen 30 and records an image, a maintenance state in which the print head 36 faces the maintenance unit and undergoes maintenance, and a manual task state in which a manual task (a second maintenance) is carried out on the print head 36. The image recording device 1 is further configured so that a simple configuration allows for efficient switching between the maintenance state and the other states (the image recording state and the manual task state). What follows is a more detailed description of this feature.

Figure 3:
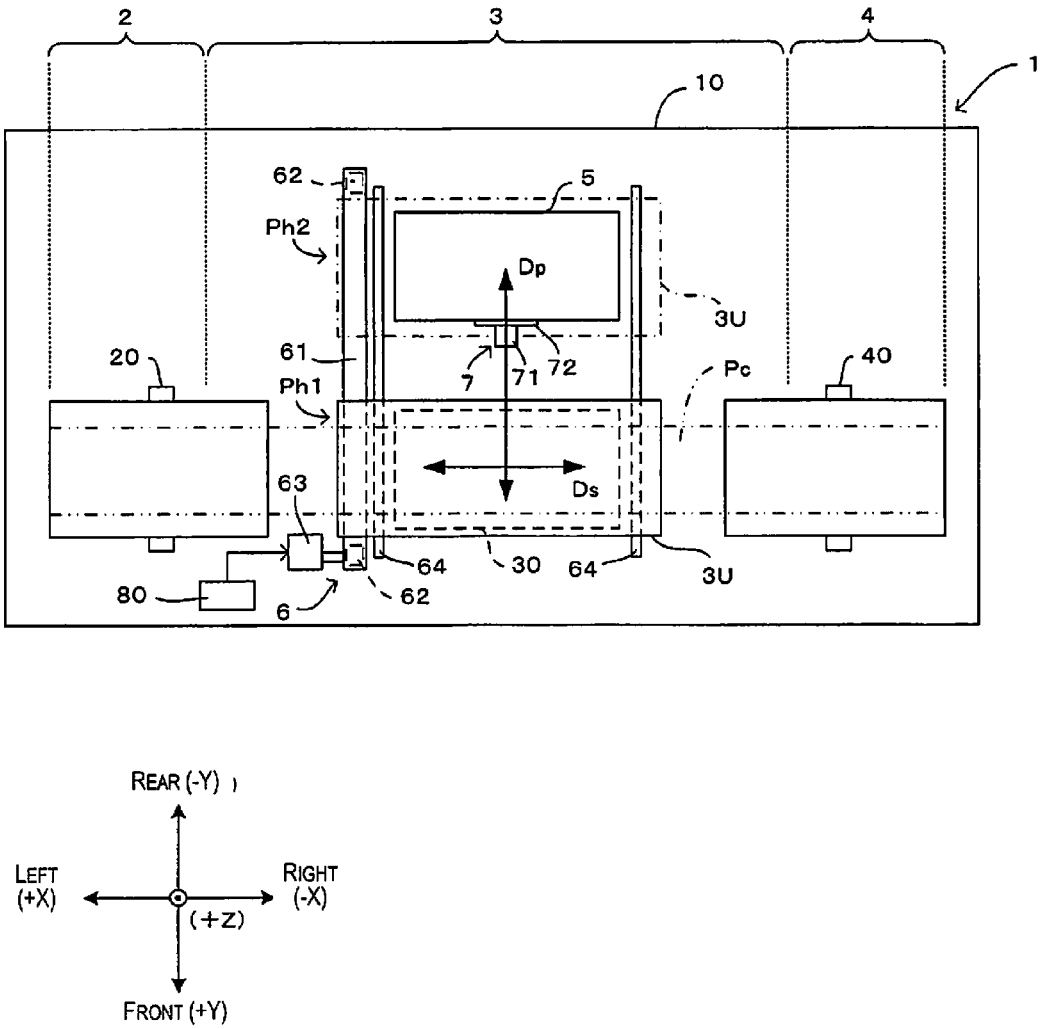
FIG. 3 is a plan view illustrating the positional relationships between each of the members in the image recording state.
Figure 4:
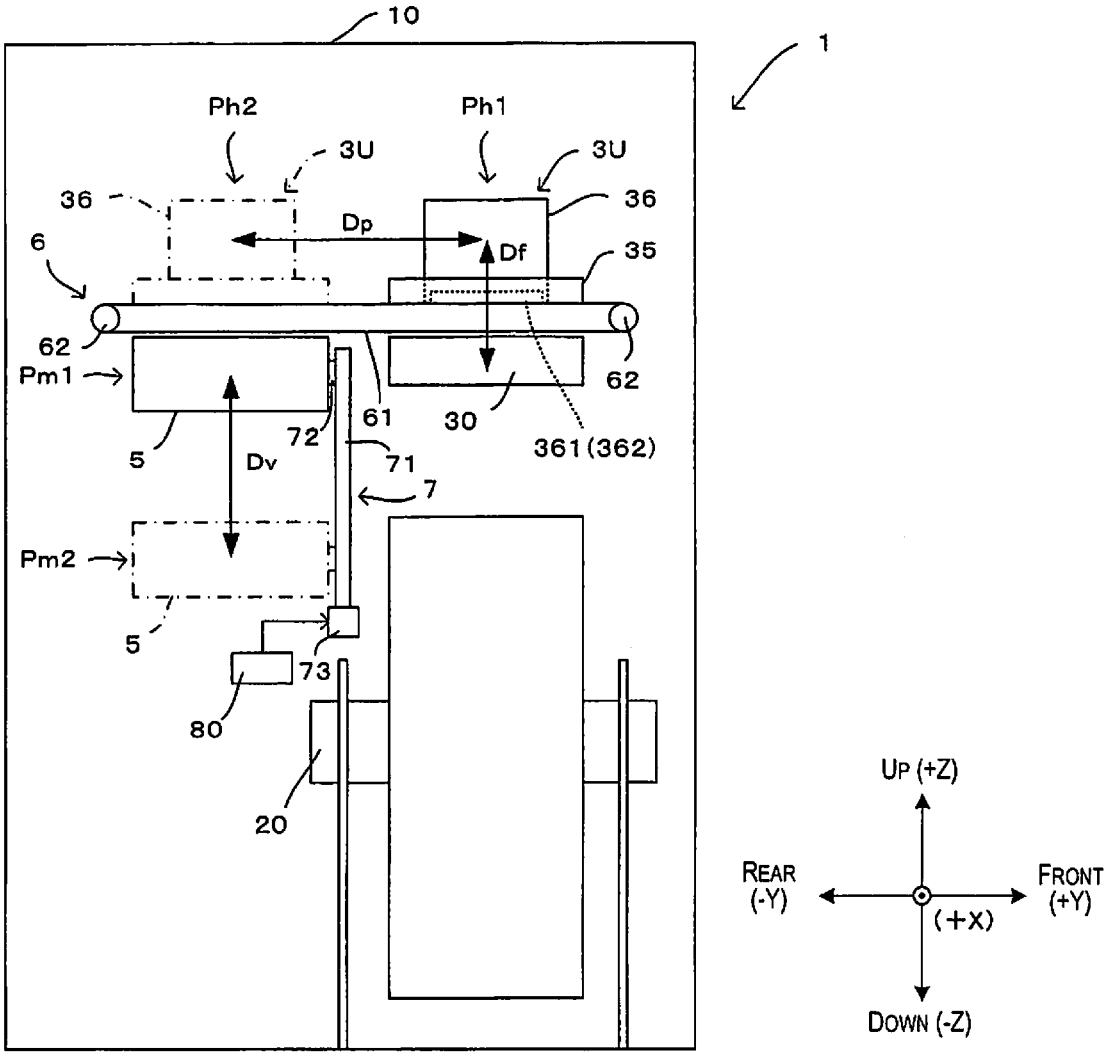
FIG. 4 is a side view illustrating the positional relationships between each of the members in the image recording state.
Figure 5:
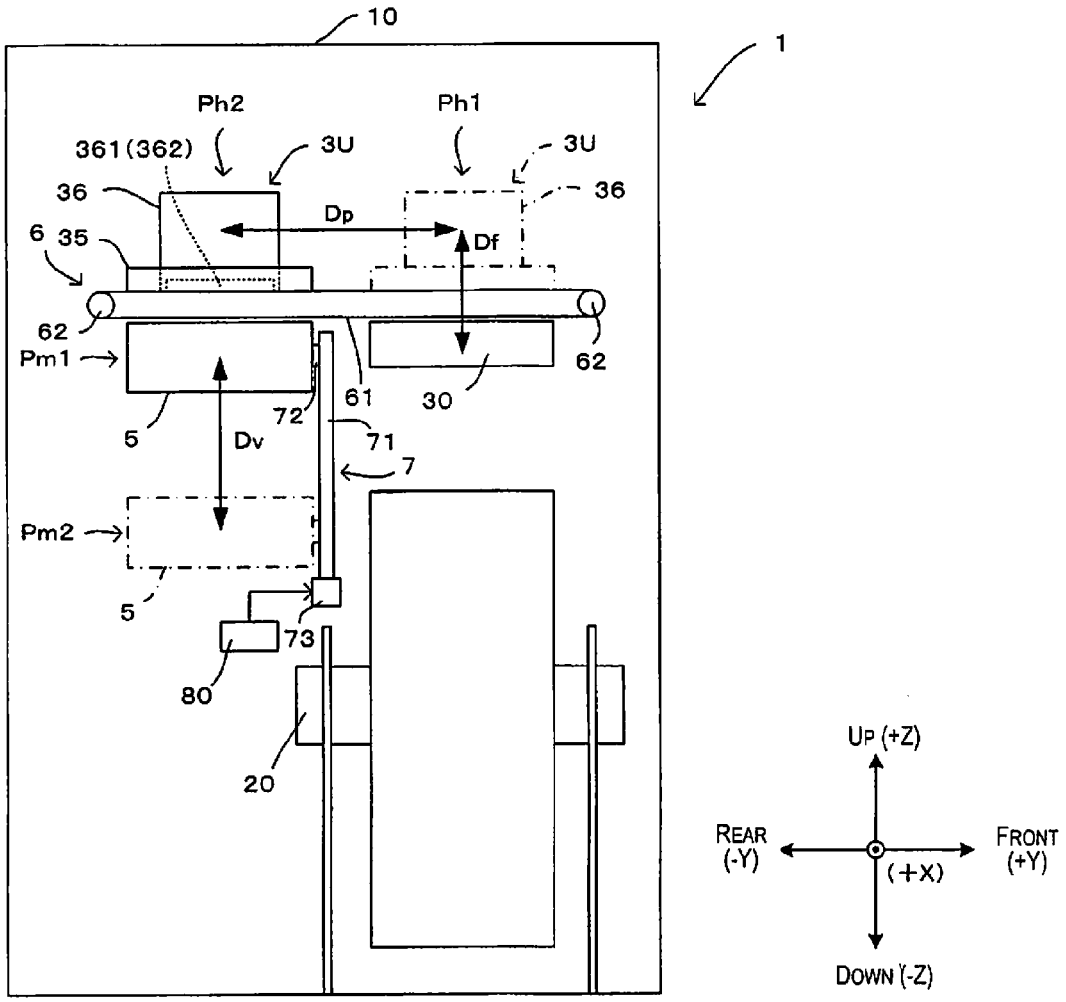
FIG. 5 is a side view illustrating the positional relationships between each of the members in the maintenance state.
Figure 6:
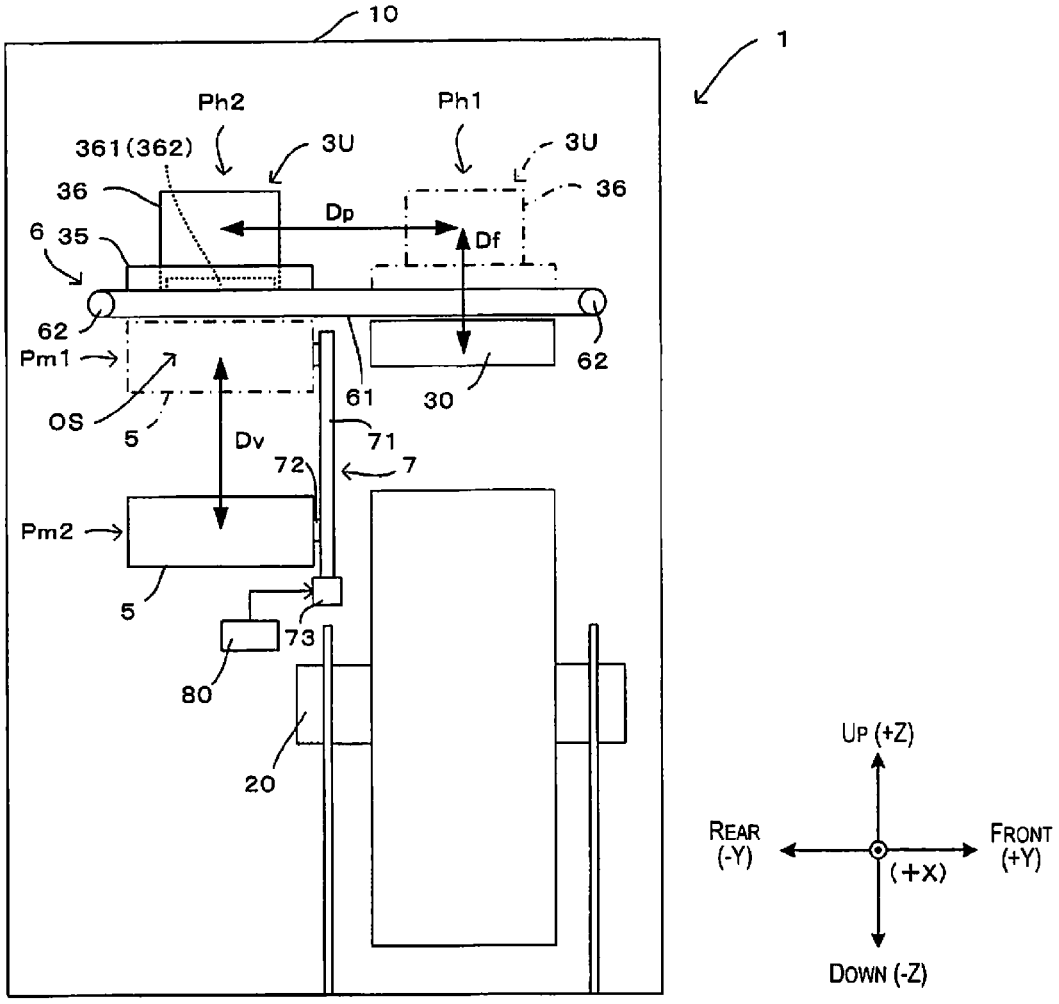
FIG. 6 is a side view illustrating the positional relationships between each of the members in the manual task state.

FIG. 3 is a plan view illustrating the positional relationship between each of the members in the image recording state, and FIGS. 4 to 6 are side views illustrating the positional relationships between each of the members in the image recording state, the maintenance state, and the manual task state, respectively. To facilitate understanding of the description for FIGS. 3 to 6, the depiction is mainly of the positional relationships between the head unit 3U, the platen 30, and the maintenance unit 5, with other members omitted as appropriate from being described.

As illustrated in FIG. 3, in the present embodiment, the maintenance unit 5 is disposed to the rear of the platen 30, which is arranged near the front middle section of the image recording device 1. A first guide mechanism 6 is provided so that the head unit 3U can move along an orthogonal direction Dp (front-back direction) orthogonal in plan view to the conveyance direction Ds (left-right direction) of the sheet S. The first guide mechanism 6 guides the movement of the head unit 3U between an image recording position Ph1 facing the platen 30, and a maintenance-receiving position Ph2, which is a different position from that of the platen 30 in the orthogonal direction Dp. Also, as illustrated in FIGS. 4 to 7, a second guide mechanism 7 is provided so that the maintenance unit 5 can move along the vertical direction Dv (up-down direction) at the rear of the platen 30. The second guide mechanism 7 guides the movement of the maintenance unit 5 between a maintenance position Pm1 and withdrawn position Pm2 for drawing closer to or drawing away from, respectively, the head unit 3U at the maintenance-receiving position Ph2.

As illustrated in FIG. 4, when the maintenance unit 3U is at the image recording position Ph1, the image recording state comes into effect, in which the print head 36 faces the platen 30 and ink can be discharged onto the sheet S, which is on the platen 30, to record an image. At the image recording position Ph1, the head unit 3U is configured so as to be able to move, albeit only slightly, in the direction of drawing near to or away from the platen 30, i.e., the vertical direction. Having such a configuration makes it possible to minimize contact between the head unit 3U and the platen 30, by moving the head unit 3U in a state where there is a greater gap between the head unit 3U and the platen 30 (a separated state) than a state where the head unit 3U and the platen 30 are brought closer together to record an image (a near state).

When the head unit 3U is at the maintenance-receiving position Ph2, it is possible to selectively adopt, depending on the position of the maintenance unit 5, either the maintenance state in which the maintenance unit 5 is able to perform the maintenance on the print head 36, or the manual task state in which the worker is able to perform the manual task on the print head 36. That is to say, as illustrated in FIG. 5, the state where the maintenance unit 5 is able to perform the maintenance on the print head 36 comes into effect when the maintenance unit 5 is at the maintenance position Pm1 drawing near in the state of facing the head unit 3U, in the state where the head unit 3U is at the maintenance-receiving position Ph2. At this time, the head unit 3U can be moved so as to draw even closer to the maintenance unit 5, which is positioned at the maintenance position Pm1. In turn, as illustrated in FIG. 6, the manual task state in which is ensured the open space OS (FIG. 6) allowing the worker to insert a hand below the maintenance unit 5 is in effect when the maintenance unit 5 is at the withdrawn position Pm2 drawing vertically downward away from the head unit 3U, in the state where the head unit 3U is at the maintenance-receiving position Ph2. In the manual task state, not only can each of the parts of the head unit 3U be cleaned by the manual task, but also tasks such as replacing the light-emitting units 372 of the UV lamp 37 or the print head 36 can also be carried out. For the open space OS, there needs to be at least a space that allows the worker to insert a hand between the print head 36 and the maintenance unit 5; preferably, the opposing surfaces of the print head 36 and the maintenance unit 5 are separated by 20 cm or more.

The first guide mechanism 6 (see FIG. 3) for guiding the movement of the head unit 3U in the orthogonal direction Dp is configured to include a guide belt 71 provided extending in the orthogonal direction Dp, a pair of pulleys 62 around which the inside of the guide belt 61 is wound at both ends of the guide belt 61 in the direction of extension, a motor 63 that is linked to one of the pair of pulleys 62 (the one in the front) and rotatingly drives that one pulley 62, and a pair of left and right guide rails 64 provided extending in the orthogonal direction Dp. The lower surface of the head support section 35 of the head unit 3U is attached to the guide belt 61, and is also supported by the guide rails 64 so as to be able to slide in the orthogonal direction Dp over the pair of guide rails 64.

When a command coming from a control unit 80 causes the motor 63 to operate, the guide belt 61 rotates, and, in association with the rotation of the guide belt 61, the head support section 35 moves in the orthogonal direction Dp while being supported by the pair of guide rails 64. As a result, the entirety of the head unit 3U moves in the orthogonal direction Dp. The control of the movement of the head unit 3U to each of the positions Ph1, Ph2 can be carried out by controlling the rotational speed of the motor 63 in accordance with the distance between each of the positions, or can be carried out on the basis of the detection of a position sensor provided so as to be able to detect the position of the head unit 3U in the orthogonal direction Dp. The print heads 36*a* to 36*e* provided to the head unit 3U are arranged so as to be located between the pair of guide rails 64 (see FIG. 1), and the guide rails 64 are configured so as to be unlikely to become a hindrance in a case where a worker is accessing the nozzle formation surface of the print heads 36*a* to 36*e* or the like.

The second guide mechanism 7 (see FIG. 4) for guiding the movement of the maintenance unit 5 in the vertical direction Dv is configured to include a ball screw 71 provided extending in the vertical direction Dv, a bracket 72 that is screwed onto the ball screw 71, and a motor 73 for rotatingly driving the ball screw 71. The maintenance unit 5 is attached to the bracket 72, and when a command coming from the control unit 80 causes the motor 73 to operate, the ball screw 71 rotates and the bracket 72 moves in the vertical direction Dv. As a result, the maintenance unit 5 moves in the vertical direction Dv. The control of the movement of the maintenance unit 5 to each of the positions Pm1, Pm2 can be carried out by controlling the rotational speed of the motor 73 or can be carried out utilizing a position sensor, similarly with respect to the control of the movement of head unit 3U.

In the image recording device 1 configured as above, during a transition from the image recording state (FIG. 4) to the maintenance state (FIG. 5), the head unit 3U need only be brought, at the image recording position Ph1, from the near state to the separated state in relation to the platen 30, the motor 63 being actuated to move the head unit 3U from the image recording position Ph1 to the maintenance-receiving position Ph2. During a transition from the maintenance state (FIG. 5) to the manual task state (FIG. 6), the motor 73 need only be actuated to move the maintenance unit 5 from the maintenance position Pm1 to the withdrawn position Pm2. It shall be readily understood that the patterns of movement of the head unit 3U and the maintenance unit 5 illustrated herein are merely an example, and that other patterns of movement can also be adopted. What follows provides illustrative examples of other patterns of movement.

For example, the present embodiment had the maintenance unit 5 be positioned at the maintenance position Pm1 in the image recording state illustrated in FIG. 4, but the maintenance unit 5 can be at the withdrawn position Pm2 in the image recording state. In such a case, transitioning from the image recording state to the maintenance state need only include moving the head unit 3U from the image recording position Ph1 to the maintenance-receiving position Ph2 and also moving the maintenance unit 5 from the withdrawn position Pm2 to the maintenance position Pm1. At this time, the motors 63, 73 can be actuated at the same time to rapidly switch to the maintenance state by moving the head unit 3U and the maintenance unit 5 at the same time.

In a case where the head unit 3U and the maintenance unit 5 are being moved at the same time in this manner, preferably, the first guide mechanism 6 and the second guide mechanism 7 are configured so as to prevent the head unit 3U and the maintenance unit 5 from interfering with each other. More specifically, as per the present embodiment, preferably, the first guide mechanism 6 and the second guide mechanism 7 are disposed so as to prevent overlapping or intersection between the movement trajectory for when the head unit 3U is moving between the image recording position Ph1 and the maintenance-receiving position Ph2 (the movement trajectory running along the direction of extension of the guide rails 64) and the movement trajectory for when the maintenance unit 5 is moving between the maintenance position Pm1 and the withdrawn position Pm2 (the movement trajectory running along the direction of extension of the ball screw 71). So doing makes it possible to prevent the head unit 3U and the maintenance unit 5 from coming into contact with each other, and makes it possible to efficiently switch to each of the states without having to be concerned about contact between the two members even in a case where the head unit 3U and the maintenance unit 5 are moving at the same time.

As per the above, according to the present embodiment, the facing direction Df, the orthogonal direction Dp, and the vertical direction Dv are equivalent to the "first direction" of the invention, the "second direction" of the invention, and the "third direction" of the invention, respectively. The maintenance on the print head 36 is executed in the state where the print head 36 has been guided to the maintenance-receiving position Ph2 by the first guide mechanism 6 and has been separated away from the platen 30 in the orthogonal direction Dp. That is to say, switching between the image recording state and the maintenance state need not necessitate insertion and removal of the maintenance unit 5 between the print head 36 and the platen 30, and the switch between states can be executed with a relatively simple configuration. Further, the provision of the second guide mechanism 7 for guiding the maintenance unit 5 between the maintenance position Pm1 and the withdrawn position Pm2 and the movement of the maintenance unit 5 to the maintenance position Pm1 or the withdrawn position Pm2 in the state where the print head 36 is at the maintenance-receiving position Ph2 makes it possible to efficiently switch between the maintenance state and the manual task state. As such, the switch between the maintenance state and another state can be efficiently carried out with a simple configuration.

Also connected to the head unit 3U of the present embodiment are: an electrical wiring (not shown) for driving the print head 36, the UV lamp 37, and the like; an ink supply tube (not shown) for supplying the ink to the print head 36; or the suction hose 382 of the mist suction section 38 (FIG. 2), and the like (hereinbelow all referred to as a "wiring and the like"). As such, in some instances there can arise a need to lengthen the wiring and the like when adopting a configuration where the head unit 3U is moved from the maintenance-receiving position Ph2 to yet another position in order for the manual task state to come into effect. So doing has risked causing degradation of electrical signals, diminishing of the capacity for ink supply and the capacity for mist suction, or greater device weight and costs. However, in the present embodiment, the switch to the manual task state is made by moving the maintenance unit 5 to the withdrawn position Pm2 while the head unit 3U remains positioned at the maintenance-receiving position Ph2, and therefore there is no need to move the head unit 3U from the maintenance-receiving position Ph2 to yet another position, and any lengthening of the wiring and the like can be minimized.

Also, the separated provision of the first guide mechanism 6 for guiding the movement of the print head 36 and the second guide mechanism 7 for guiding the movement of the maintenance unit 5 as per the present embodiment creates the following advantages. Because the print head 36 is the site where image recording takes place, enhancing the accuracy of images necessitates strictly and precisely positioning the print head 36. However, the required level of accuracy in positioning the maintenance unit 5 in order to execute the maintenance on the print head 36 is generally more lenient when compared to the print head 36. As such, having the second guide mechanism 7 for guiding the movement of the maintenance unit 5 be provided separately from the first guide mechanism 6 for guiding the movement of the print head 36 lowers the level of accuracy required for the second guide mechanism 7 and makes it possible to minimize the device production costs.

Further, in the present embodiment, the maintenance-receiving position Ph2 is in a region (outside the region that is present between the two-dot chain lines in FIG. 3) separated apart from the conveyance path Pc on which the sheet S is conveyed in plan view. According to this configuration, the maintenance-receiving position Ph2 does not overlap with the conveyance path Pc of the sheet S in plan view. As such, when the manual task is being carried out or when the maintenance is being carried out on the print head 36 at the maintenance-receiving position Ph2, it is possible to prevent the ink that has attached to the print head 36 from falling down or spreading to the sheet S on the conveyance path Pc and sullying the sheet S. Furthermore, in the present embodiment, the orthogonal direction Dp is orthogonal to the conveyance direction Ds as seen in plan view, and the image recording position Ph1 and the maintenance-receiving position Ph2 are arranged side by side along the orthogonal direction Dp. As a result, it is possible to shorten the distance between the image recording position Ph1 and the maintenance-receiving position Ph2, separated from the conveyance path Pc, and therefore the print head 36 can be rapidly moved between the image recording position Ph1 and the maintenance-receiving position Ph2, and also the time required in order to switch between the image recording state and the maintenance state can be curtailed.

Also, in the present embodiment, the maintenance position Pm1 and the withdrawn position Pm2 are understood to be different positions in the vertical direction Dv. When this is so, moving the maintenance unit 5 from the maintenance position Pm1 to the withdrawn position Pm2 makes it possible to ensure the open space OS (FIG. 6), which is open in the vertical direction Dv, and to switch to the manual task state. That is to say, it is possible to switch to the manual task state while also minimizing the amount of travel of the maintenance unit 5 in the horizontal direction, and possible to reduce the device scale in the horizontal direction. In particular, when the maintenance position Pm1 and the withdrawn position Pm2 are arranged side by side along the vertical direction Dv, as in the present embodiment, then the device scale can be even further reduced in the horizontal direction, which is even more preferable.

Figure 7:
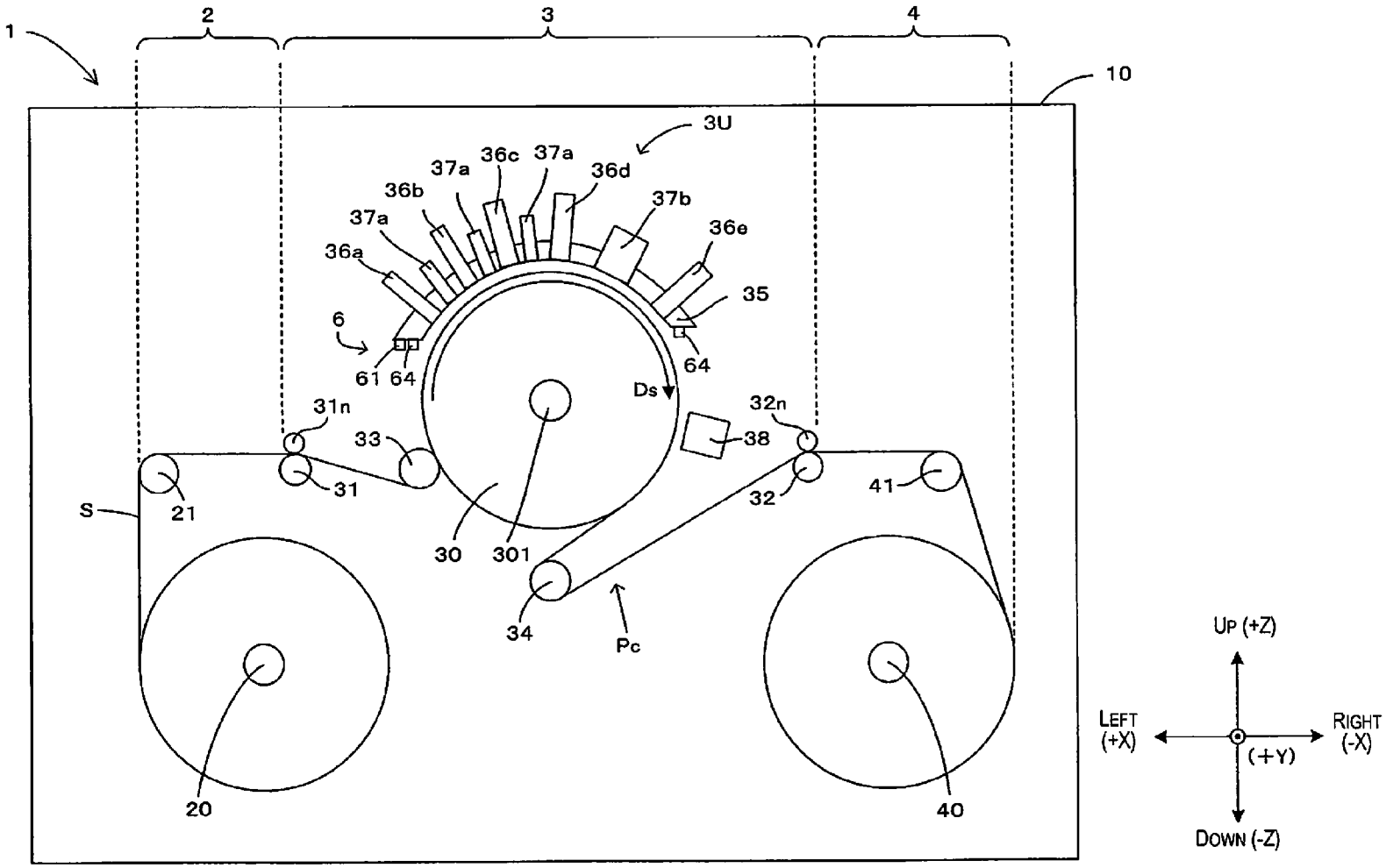
FIG. 7 is a front view schematically illustrating another embodiment of an image recording device as in the invention.

The invention is not to be limited to the embodiment described above; rather, a variety of different modifications can be added to what has been described above, provided that there is no departure from the spirit of the invention. For example, the embodiment described above used the flat-shaped platen 30 as the "support member" of the invention, but it would also be possible to use an embodiment in which a drum-shaped platen 30 is used, as is illustrated in FIG. 7. Herein, FIG. 7 is a front view schematically illustrating another embodiment of an image recording device as in the invention. The present embodiment differs from the embodiment described above mainly in the shape of the platen 30, but is similar to the embodiment described above in the other basic device configurations and operations. As such, a description for portions in common with the embodiment described above is omitted. It shall be readily understood that the present embodiment, by also being provided with a configuration in common with the embodiment described above, exhibits similar effects to those of the embodiment described above.

As illustrated in FIG. 7, in the present embodiment, the platen 30 provided to the process section 3 is a rotating drum, which is of a drum type having a cylindrical shape. More specifically, the platen 30 is supported by a support mechanism (not shown) so as to freely rotate about a rotating shaft 301 extending in the front-back direction (Y-direction), and the sheet S being conveyed from the front drive roller 31 toward the rear drive roller 32 is wound therearound from the back surface side. The platen 30 is intended to support the sheet S from the back surface side while also being driven to rotate in the conveyance direction Ds of the sheet S, under the force of friction against the sheet S. Also provided are the driven rollers 33, 34 at which the sheet S is looped back at both sides of the section wound around the platen 30. Of these, the driven roller 33 loops the sheet S around with the surface of the sheet S wound therearound between the front drive roller 31 and the platen 30. In turn, the driven roller 34 loops the sheet S around with the surface of the sheet S wound therearound between the platen 30 and the rear drive roller 32. In this manner, the sheet S is looped around upstream and downstream of the platen 30 in the conveyance direction Ds, whereby the length of the section of the sheet S wound around the platen drum 30 can be ensured. Thus, the sheet S being conveyed from the front drive roller 31 toward the rear drive roller 32 is conveyed in the conveyance direction Ds over the platen 30 while being supported by the outer peripheral surface of the platen 30.

In association with the platen 30 being a drum type, the print heads 36*a* to 36*e* and the UV lamps 37*a*, 37*b* are arrayed along the outer peripheral surface of the arcuate shape of the platen 30. The print heads 36*a* to 36*e* and the UV lamps 37*a*, 37*b*, which are supported by the head support section 35, thus are integrated with the head support section 35 to constitute the head unit 3U. The head support section 35 is able to slide along the axial direction (Y-direction) of the rotating shaft 301 of the platen 30, over the pair of left and right guide rails 64 of the first guide mechanism 6, and when the head support section 35 moves in the axial direction, the entirety of the head unit 3U also moves in the axial direction. This manner of support, by the head support section 35, of the print heads 36*a* to 36*e* and UV lamps 37*a*, 37*b* arranged side by side along the outer peripheral surface of the arcuate shape of the platen 30, and of movement of the head support section 35 along the axial direction of the drum-type platen 30, makes it possible to move the head unit 3U while minimizing interference between the head unit 3U and the platen 30.

Other Modification Examples

The embodiments described above had the maintenance unit 5 arranged to the rear of the platen 30, but the relative position relationship thereof is not limited thereto, and it would also be possible, for example, for the maintenance unit 5 to be arranged to the front of the platen 30.

Also, in the embodiments described above, the maintenance-receiving position Ph2 was understood to be a position separated apart from the platen 30 in the orthogonal direction Dp orthogonal to the conveyance direction Ds as seen in plan view. However, the maintenance-receiving position Ph2 need only be separated apart from the platen 30 in the direction orthogonal to the facing direction (direction of relative motion) Df (FIG. 4) between the print head 36 and the platen 30 in the image recording state, and there is no need to be separated apart from the platen 30 in the orthogonal direction Dp orthogonal to the conveyance direction Ds as seen in plan view. For example, the maintenance-receiving position Ph2 can be a position that is separated apart from the platen 30 in the conveyance direction Ds. The significance of "separated apart from" herein also encompasses a state where the print head 36 at the maintenance-receiving position Ph2 partially overlaps with the platen 30 in the direction orthogonal to the facing direction Df, provided that the maintenance unit 5 be able to carry out the maintenance on the print head 36 at the maintenance-receiving position Ph2. The image recording position Ph1 and the maintenance-receiving position Ph2 can also be arranged side by side along a direction other than the orthogonal direction Dp.

The embodiments described above also had the maintenance position Pm1 and the withdrawn position Pm2 arranged side by side along the vertical direction Dv. However, the positional relationship between the maintenance position Pm1 and the withdrawn position Pm2 is not limited thereto. For example, it would also be possible to use a configuration where the withdrawn position Pm2 is a position separated apart from the head unit 3U at the maintenance-receiving position Ph2 as seen in plan view, thus causing the maintenance unit 5 to be drawn apart from the head unit 3U by being moved to the withdrawn position Pm2, and thus forming an open space between the head unit 3U at the maintenance-receiving position Ph2.

The embodiments described above had the withdrawn position Pm2 be only one location, but it would also be possible to the withdrawn position Pm2 to be provided at a plurality of locations. For example, in the case of carrying out a manual task not requiring such a broad open space between the head unit 3U, the movement of the maintenance unit 5 can be stopped at a position ahead of the withdrawn position Pm2 illustrated in FIG. 6 (on the maintenance position Pm1 side), this position serving as the withdrawn position Pm2 to carry out the manual task. This configuration providing a plurality of withdrawn positions Pm2 and allowing for the appropriate withdrawn position Pm2 to be selected depending on the type of manual task makes it possible to reduce the distance of movement for the maintenance unit 5 in transitioning to the manual task state, and possible to curtail the time needed to transition to the manual task state.

Also, the embodiments described above had a plurality of print heads 36 integrally configured to be the one head unit 3U, where moving the head unit 3U positioned each of the print heads 36 at either the image recording position Ph1 or the maintenance-receiving position Ph2 and made it possible to switch states. However, positioning each of the print heads 36 at the image recording position Ph1 or at the maintenance-receiving position Ph2 by moving the one head unit 3U is not an essential requirement for the invention. For example, the configuration can be one where a plurality of head units 3U are provided and the print heads 36 are provided to each of the head units 3U, or the configuration can be one where no head unit 3U is provided, and each of the print heads 36 is moved individually.

Described above had the first guide mechanism 6 be a belt drive mechanism using the guide belt 61 and the motor 63, and had the second guide mechanism 7 be a ball screw drive mechanism using the ball screw 71 and the motor 73, the movements of the head unit 3U and of the maintenance unit 5 both being controlled by the control unit 80. However, another configuration can be employed as the first guide mechanism and the second guide mechanism 7. A drive mechanism also need not necessarily be provided, and the worker can move the head unit 3U or the maintenance unit 5 by hand.

The above embodiments were configured so that when the head unit 3U is at the image recording position Ph1, a switch can be made between the near state where the head unit 3U is brought near to the platen 30 and an image is recorded, and the separated state where the gap between the head unit 3U and the platen 30 is increased and contact during movement can be minimized. However, configuring so that the head unit 3U adopts the near state and the separated state at the image recording position Ph1 is not an essential requirement.

An image recording device as in the embodiment includes: a support member for supporting a recording medium that is conveyed in a conveyance direction; a print head for ejecting a liquid from a nozzle to record an image on the recording medium on the support member, at an image recording position facing the support member; a maintenance unit for executing a first maintenance on the print head; a first guide mechanism for guiding movement of the print head between the image recording position and a maintenance-receiving position, which is a position different from that of the support member in a second direction orthogonal to a first direction in which the print head at the image recording position and the support member face each other; and a second guide mechanism for guiding movement of the maintenance unit between a withdrawn position for separating away from the print head in a third direction, which is a direction orthogonal to the second direction, in relation to the print head at the maintenance-receiving position, and a maintenance position for drawing nearer to the print head than the withdrawn position; the maintenance unit, when at the maintenance unit, facing the print head at the maintenance-receiving position and being able to execute the first maintenance on the print head, and when the maintenance unit is at the withdrawn position, there existing between the print head at the maintenance-receiving position and the maintenance unit a space allowing for a second maintenance by manual task to be performed on the print head.

In the embodiment (image recording device) thus configured, the print head ejects a liquid from a nozzle to record an image on the recording medium on the support member, at the image recording position facing the support member (the image recording state). Also, the first guide mechanism for guiding the movement of the print head between the image recording position and the maintenance-receiving position is provided. Moving the print head to the maintenance-receiving position, then, makes it possible to move the print head to a position different from that of the support member in the second direction orthogonal to the first direction in which the print head at the image recording position and the support member face each other. Further, the second guide mechanism to drawing the maintenance unit closer to or farther from the print head at the maintenance-receiving position is provided. That is to say, the maintenance unit is able to move between the withdrawn position, for drawing apart from the print head in the third direction orthogonal to the second direction in relation to the print head at the maintenance-receiving position, and the maintenance position for drawing nearer to the print head than the withdrawn position. The, moving the maintenance unit to the maintenance position causes the maintenance unit to face the print head at the maintenance-receiving position, thus making it possible for the maintenance unit to execute the first maintenance on the print head (the maintenance state). Moving the maintenance unit to the withdrawn position forms a space in which the second maintenance by manual task can be performed on the print head, between the print head at the maintenance-receiving position and the maintenance unit, and makes it possible to execute the second maintenance by manual task on the print head (manual task state).

Herein, according to the embodiment, the maintenance on the print head is carried out in the state where the print head has been guided to the maintenance-receiving position and separated apart from the support member in the second direction by the first guide mechanism. That is to say, switching between the image recording state and the maintenance state need not necessitate insertion and removal of the maintenance unit between the print head and the support member, and the switch between states can be executed with a relatively simple configuration. Further, the provision of the second guide mechanism for guiding the maintenance unit between the maintenance position and the withdrawn position and the movement of the maintenance unit to the maintenance position or the withdrawn position in the state where the print head is at the maintenance-receiving position makes it possible to efficiently switch between the maintenance state and the manual task state. As per the foregoing, in the embodiment, it becomes possible to efficiently switch between the maintenance state and the other states with a simple configuration.

When the maintenance-receiving position is separated apart from the conveyance path on which the recording medium is conveyed as seen in plan view, then the maintenance-receiving position does not overlap with the conveyance path of the recording medium as seen in plan view. As such, when the manual task is being carried out or when the maintenance is being carried out on the print head at the maintenance-receiving position, it is possible to prevent the ink that has attached to the print head from falling down or spreading to the recording medium on the conveyance path and sullying the recording medium. In such a case, preferably, the second direction is orthogonal to the conveyance direction as seen in plan view, and the image recording position and the maintenance-receiving position are arranged side by side along the second direction. In this manner, it is possible to shorten the distance between the image recording position and the maintenance-receiving position, separated from the conveyance path Pc, and therefore the print head can be rapidly moved between the image recording position and the maintenance-receiving position, and also the time required in order to switch between the image recording state and the maintenance state can be curtailed.

Also, the maintenance position and the withdrawn position can be positions that are different in the vertical direction. In this manner, moving the maintenance unit from the maintenance position to the withdrawn position makes it possible to ensure an open space opening in the vertical direction, to switch to the manual task state. That is to say, it is possible to switch to the manual task state while also minimizing the amount of travel of the maintenance unit in the horizontal direction, and possible to reduce the device scale in the horizontal direction. Herein, when the maintenance position and the withdrawn position are arranged side by side along the vertical direction, then the device scale can be even further reduced in the horizontal direction, which is even more preferable.

Preferably, the first guide mechanism and the second guide mechanism are configured so as to be able to move at the same time the print head, the movement of which is guided by the first guide mechanism, and the maintenance unit, the movement of which is guided by the second guide mechanism, it being thereupon possible to switch rapidly in a case where there is a need to move both of the members when switching to each of the states. Herein, contact between the print head and the maintenance unit can be prevented when the first guide mechanism and the second guide mechanism are configured so as to prevent interference between the print head, the movement of which is guided by the first guide mechanism, and the maintenance unit, the movement of which is guided by the second guide mechanism. As such, a switch can be efficiently made to each of the states, without having to be concerned about contact between the two members, even in a case where the print head and the maintenance unit are being moved at the same time.

Also preferable is a configuration such that the image recording device is further provided with a head support section for supporting a plurality of print heads disposed along the conveyance direction, the plurality of print heads moving along with the head support section when the head support section moves. In some instances, a plurality of print heads are provided, such as where color printing is being carried out, but according to a configuration where the plurality of print heads move along with the head support section in such a case, all of the print heads can be moved at once by moving the head support section, thus facilitating switching to each of the states.

The configuration can be such that the support member is a rotating drum that has a cylindrical shape and that has a rotating shaft that extends in the second direction, the plurality of print heads being arranged side by side so as to run along an outer peripheral surface of the rotating drum and supported by the head support section, and the first guide mechanism guiding the movement of the head support section along the second direction. When the plurality of print heads are arrayed so as to run along the outer peripheral surface of the cylindrical rotating drum, interference is prone to take place between the print heads and the rotating drum when the print heads are moved. Therefore, as per the above configuration, having the direction in which the rotating shaft of the rotating drum extends and the direction of movement of the head support section for supporting the plurality of print heads both run along the second direction makes it possible to minimize any interference between the print head and the rotating drum.

What is claimed is:

1. An image recording device comprising:

a support member having a support surface configured and arranged to support a recording medium that is conveyed in a conveyance direction;

a print head configured and arranged to eject a liquid from a nozzle to record an image on the recording medium on the support surface of the support member, at an image recording position facing the support surface of the support member;

a maintenance unit configured and arranged to face the print head and execute a maintenance on the print head when the print head is disposed at a maintenance-receiving position, which is a position different from the image recording position, with respect to a width direction of the recording medium, which is a direction intersecting the conveyance direction;

a first guide mechanism configured and arranged to guide movement of the print head between the image recording position and the maintenance-receiving position along the width direction of the recording medium; and a second guide mechanism configured and arranged to guide movement of the maintenance unit between a withdrawn position for separating away from the print head and a maintenance position for drawing nearer to the print head than the withdrawn position while the maintenance unit faces the print head disposed at the maintenance-receiving position, a surface of the maintenance unit facing the print head when the maintenance unit is at the withdrawn position being disposed farther away from the print head in a movement direction of the maintenance unit by the second guide mechanism than a portion of the support surface of the support member that is disposed closest to the print head, the second guide mechanism including a guide rail connecting the withdrawn position and the maintenance position, the guide rail having a longitudinal axis extending parallel to a direction in which the maintenance unit faces the print head disposed at the maintenance-receiving position.

2. The image recording device as set forth in claim 1, wherein the maintenance-receiving position is separated apart from the conveyance path on which the recording medium is conveyed as seen in plan view.

3. The image recording device as set forth in claim 2, wherein as seen in plan view, the width direction of the recording medium is orthogonal to the conveyance direction, and the image recording position and the maintenance-receiving position are arranged side by side along the width direction of the recording medium.

4. The image recording device as set forth in claim 1, wherein the maintenance position and the withdrawn position are different positions in the vertical direction.

5. The image recording device as set forth in claim 1, wherein the first guide mechanism and the second guide mechanism are configured so that the print head, the movement of which is guided by the first guide mechanism, and the maintenance unit, the movement of which is guided by the second guide mechanism, can be moved at the same time.

6. The image recording device as set forth in claim 1, wherein the first guide mechanism and the second guide mechanism are configured so as to prevent interference between the print head, the movement of which is guided by the first guide mechanism, and the maintenance unit, the movement of which is guided by the second guide mechanism.

7. The image recording device as set forth in claim 1, further comprising a head support section supporting a plurality of the print heads disposed along the conveyance direction, the plurality of print heads moving along with the head support section when the head support section moves.

8. The image recording device as set forth in claim 7, wherein the support member is a rotating drum that has a cylindrical shape and that has a rotating shaft that extends in the second direction, the plurality of print heads being arranged side by side so as to run along an outer peripheral surface of the rotating drum and supported by the head support section, and the first guide mechanism guiding the movement of the head support section along the width direction of the recording medium.

* * * * *